US005217292A

United States Patent [19]

Chalberg

[11] Patent Number: 5,217,292

[45] Date of Patent: Jun. 8, 1993

[54] WHIRLPOOL BATH SUCTION ASSEMBLY HAVING REPLACEABLE TUB LIGHT THEREIN

[75] Inventor: Philip E. Chalberg, Costa Mesa, Calif.

[73] Assignee: Hydrabaths, Inc., Santa Ana, Calif.

[21] Appl. No.: 879,582

[22] Filed: May 7, 1992

Related U.S. Application Data

[63] Continuation-in-part of Ser. No. 753,681, Sep. 3, 1991.

[51] Int. Cl.[5] ..... F21V 33/00

[52] U.S. Cl. ..... 362/96; 362/101; 4/541.1

[58] Field of Search ..... 362/96, 101; 4/541.6, 4/494, 496, 541.1

[56] References Cited

U.S. PATENT DOCUMENTS

| | | | |
|---|---|---|---|
| 1,968,072 | 7/1934 | Creighton | 362/101 |
| 2,330,592 | 10/1941 | Kenrick . | |
| 4,616,298 | 10/1986 | Bolson . | |
| 4,749,126 | 6/1988 | Kessener et al. . | |
| 4,901,922 | 2/1990 | Kessener et al. . | |
| 5,000,665 | 3/1991 | Moeller . | |

*Primary Examiner*—Carroll B. Dority
*Attorney, Agent, or Firm*—Leonard Tachner

[57] ABSTRACT

An improved combination suction elbow assembly and light assembly for use in conjunction with whirlpool bath systems, wherein the embodiment of the invention shown herein is uniquely configured to provide a light assembly which may be readily removed from the inside of the bathtub for replacement of the bulb. The light assembly of the present invention is configured behind a removable deflector with a light transmissive angled surface. The deflector's angled surface minimizes the effect of the light assembly on flow through the suction elbow. In addition, the removable deflector provides a water tight seal connection to prevent any water from reaching the light assembly. A simple tool in the form of an elongated cylinder, having a plurality of wrench pin keys is disclosed. The keys are adapted to engage wrench pins along the peripheral surface of a flange of the removable deflector to enable easy threading and unthreading of the deflector into the housing from inside the tub, without requiring any access from outside the tub.

13 Claims, 5 Drawing Sheets

WHIRLPOOL BATH SUCTION ASSEMBLY HAVING REPLACEABLE TUB LIGHT THEREIN

CROSS REFERENCE TO RELATED APPLICATION

This application is a continuation-in-part of patent application Ser. No. 07/753,681 filed on Sep. 3, 1991.

BACKGROUND OF THE INVENTION

1. Field of the Invention

The present invention relates generally to whirlpool baths the like, and more specifically to a suction assembly which may be mounted on the wall of a tub receiving a whirlpool bath assembly. The suction assembly provides an electric light therein for transmitting light through a translucent suction cover into the interior of the tub, the light being uniquely removable from the interior of the tub to permit convenient replacement of worn out light bulbs.

1. Prior Art

Suction assemblies are used in whirlpool bath systems of the installed on a tub, the tub having an interior at least partially filled with water, the suction assembly removing water from the tub while at least one whirlpool jet delivers a mixture of water and air into the tub through a Venturi-type flow channel and a nozzle. It is at times, aesthetically pleasing as well as preferred for safety, to provide a light fixture in the tub wall. A tub wall fixture for whirlpool baths is manufactured by O'Ryan Industries of Seattle, Wash. (Model No. TL110P3). The light bulb is replaceable from inside the tub.

The concept of providing a combined suction assembly and light in a unitary housing is not unique. In fact, the applicant has filed a prior application for protection of the ornamental design of such a combined suction assembly and light, under Ser. No. 07/753,681 filed Sep. 3, 1991 and of which the present application is a continuation-in-part.

However, one of the significant disadvantages of such prior art combined suction assemblies and lights, is that it is impossible to replace a worn out light bulb from the tub interior on which the whirlpool bath assembly is installed. It is highly advantageous to obviate the need for a separate light fixture by providing a translucent suction assembly cover through which a light may shine into the tub interior and thus combine the function of lighting and suction into one unit. However, there is a distinct disadvantage if it is necessary to gain access to the exterior of the tub in order to change light bulbs that have worn out. Those having skill in the art to which the present invention pertains, will understand that gaining access to the exterior of the tub is not always convenient and in fact, often requires inconvenient steps that involve damage and subsequent repair to the adjacent wall structure.

One of the difficulties associated with providing a suction assembly and light combination, wherein the light is removable, is that the removability feature must also permit a structure in which the water exiting the tub through the suction assembly does not come in contact with the light or anything electrically associated with the light. Furthermore, the light must be mounted in such a way, that in addition to being removable, it does not interfere to any significant degree with the flow of water through the suction assembly so that the water suction capacity is not materially altered, which would otherwise potentially require a more powerful pump and thus increase the overall cost of the whirlpool assembly. In addition, significant water turbulence, as well as cavitation noise, should also be avoided for safety and aesthetic reasons. To the applicant's knowledge, there is no prior art which meets all of these objectives.

The following U.S. Patents are the most relevant prior art known to the applicant in the form of issued U.S. Patents:

U.S. Pat. No. 5,000,665 to Moeller is directed to an adjustable flow mini whirlpool jet and lighting assembly adapted to be mounted in an opening in the wall of a water tub for discharging the water stream into the tub. The jet assembly with housing includes a water supply line, air supply line, supply socket and adjustable ball fitting with nozzle. One embodiment of the jet assembly shown in FIG. 10 incorporates a lighting system with transparent or translucent housing threaded into the opening formed in the water supply line. A tip and light transmission line supply light from the source to the nozzle and into the tub. There is no disclosure of changing the light bulb from inside the tub.

U.S. Pat. No. 4,901,922 to Kessener et al is directed to an internally illuminated water supply fitting. The water spigot terminating in nozzle has a discharge opening and water stream. A light source with a lamp and a reflector, has its lens supplying light into an end of a light guide, a clear transparent rod of polymethyl methacrylate. The upper end of the light transmitting rod terminates adjacent to the water discharge opening so as to introduce light directly into the liquid stream.

U.S. Pat. No. 4,616,298 to Bolson is directed to a water-powered light that may be used for decorative purposes in a swimming pool or utilitarian purposes in connection with an emergency sprinkler system. The light housing has an end with a water inlet swivel coupling for connection to a source of water under pressure. A rotor assembly journaled on a shaft carries a magnet member with magnets turned by water impinging on blades of an impeller. A stator assembly with coil generates a voltage upon water flow and magnet rotation which energizes a bulb, thereby illuminating the fine water spray exiting the front end wall.

U.S. Pat. No. 2,330,592 to Kendrick is directed to an illuminating means for the discharge end of a nozzle of the type employed in dispensing inflammable fluids. The nozzle with outlet for dispensing fluid has a branch projecting rearward on the underside of the handle. This branch has a cap with a threaded end to receive a packing nut to compress packing material for a fluid-tight joint around a tube. The tube receives a rod-like element composed of a light conducting material such as methyl methacrylate. The far end of the tube ends at the discharge portion of the nozzle and has a faceting to cause spreading of the light rays. A flashlight assembly operated by a portion of the lever assembly supplies light to the rod.

U.S. Pat. No. 4,749,126 to Kessener et al is directed to several embodiments of liquid outlets adapted to provide lighting effects and/or for illumination. The fifteen embodiments of this invention rely on the fact that the light is reflected back into a media if the angle of incidence is greater than the critical angle for the media. The light in these embodiments is in the liquid stream and is not external and directed onto the liquid stream, thereby providing great efficiency with the liquid acting as a light pipe. The light is delivered to the portion of the liquid stream when it becomes turbulent, or dispenses, impacts, or breaks into drops.

There is therefore an ongoing need in the whirlpool bath art, for a combined suction assembly and light structure, wherein the light is readily removable from the inside of the tub for replacement of worn out bulbs, while simultaneously maintaining a water tight seal between the water passage within the suction assembly and the light and any electrical components associated with the light and simultaneously providing a relatively unobstructed flow path for the water exiting the tub through the suction assembly, without requiring any additional pumping pressure to otherwise overcome any reduction in flow diameter.

SUMMARY OF THE INVENTION

The present invention solves the aforementioned long felt need by providing a lighted suction elbow assembly for use in whirlpool baths, wherein a light bulb can be replaced from the inside of the tub, that is by simply removing the suction assembly cover by employing a simple wrench, the configuration of which is shown hereinafter in more detail. The light of the present invention is installed at the elbow joint of the housing of the suction assembly, utilizing a translucent, removable deflector which has an angled surface for minimizing the interference with the flow of water therethrough. The deflector is provided with a flange and threaded portion which mates with an opening at the back of the elbow joint for providing a water tight seal. The deflector is provided with a plurality of accessible pins which may be accessed from inside the tub by means of the aforementioned wrench which has a plurality of wrench pin keys adapted to mate with the pins. Using the wrench tool, the deflector may be threaded and unthreaded from inside the tub wall. The exterior side of the deflector, that is the side opposite the light transmissive angled surface thereof, is provided with means for mating with a socket retainer which receives the light bulb and light bulb socket in press-fit engagement, so that removing the deflector also removes the light bulb and socket assembly as well.

OBJECTS OF THE INVENTION

It is therefore a principal object of the present invention to provide a lighted suction elbow assembly for use in whirlpool baths and having a translucent suction cover to permit the suction assembly to serve as both a light source and a suction device on the wall of a bathtub in which the whirlpool bath assembly is mounted, the light thereof being removable from the interior of the tub for maintenance and replacement of the bulb.

It is an additional object of the present invention to provide an improved, combined light and suction assembly for use on whirlpool baths wherein the light portion thereof is removable for replacement by means of a simple tool from the interior of the tub.

It is still a further object of the present invention to provide an improved, combined suction assembly and light for use on whirlpool baths wherein the light therein is mounted for easy removal from the interior of the tub, wherein the light assembly does not significantly interfere with the flow of water through the suction assembly and wherein a water tight seal is established between the suction assembly and the light, despite its removability.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment in which:

FIG. 1(*b*) is an exploded view of a portion of the present invention showing the deflector and the light assembly portions thereof;

DETAILED DESCRIPTION OF A PREFERRED EMBODIMENT

Figure 1A:
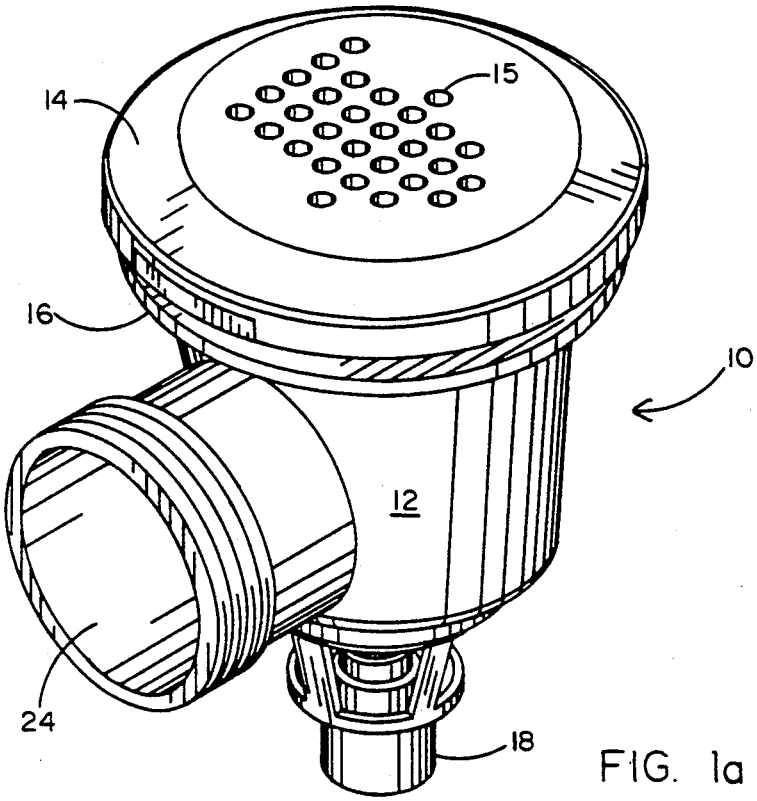
FIG. 1(*a*) is a three-dimensional drawing of the assembled combined suction assembly and light of the present invention.

Referring to the accompanying figures, it will be seen that a lighted suction elbow assembly 10 of the present invention in a preferred embodiment thereof comprises an elbow body 12 having a suction cover 14 with a plurality of holes 15. Suction cover 14 may be either transparent or translucent to light in order to serve the purpose of the invention herein described. Cover 14 may also be opaque with only holes 15 transmitting light. In the preferred embodiment shown herein, the suction cover 14 is mounted to a threaded tub extension 22 of the housing 12, which also receives a washer 16, positioned between the cover 14 and the housing. The housing 12 also provides a threaded elbow extension 24 so that water may be suctioned through the cover 14 and specifically the holes 15 therein, through the threaded tub extension 22, through the body of the housing 12 and then out through the threaded elbow extension 24. Cover 14 may be secured by a screw 34. Washer 16 has a wedge 36 which cooperates with an insert 38 on cover 14. Washer 16 has a canted segment 17 to accommodated curved tub walls.

Figure 1B:
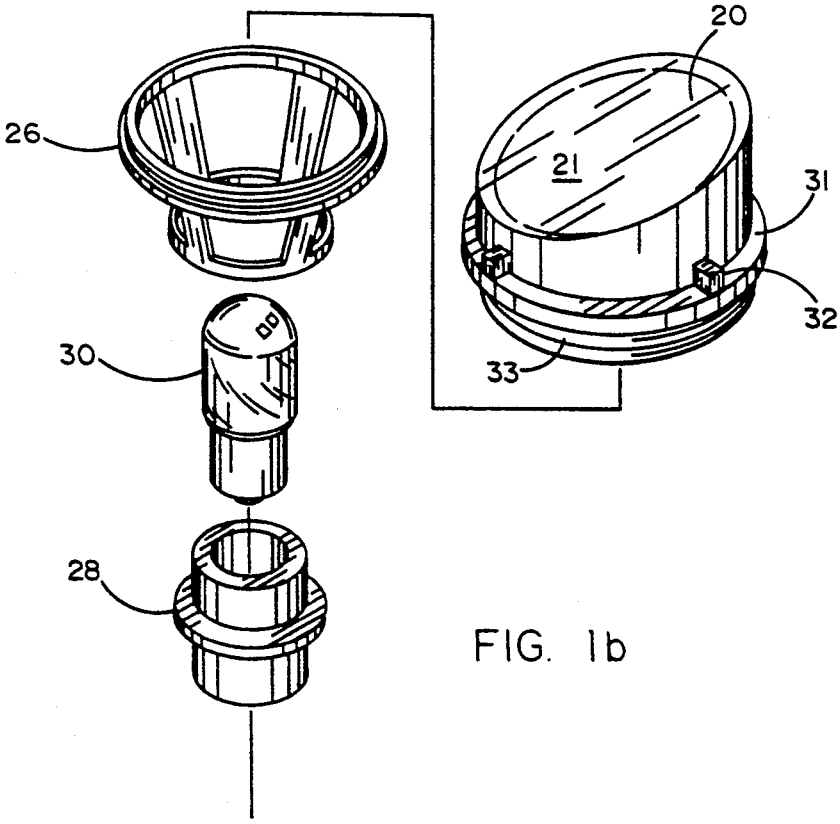

As seen best in FIGS. 1(*a*), 1(*b*) and 4, a preferred embodiment of the present invention also provides a light assembly 18 which is installed into the housing 12, but which is segregated by a water tight seal therefrom by means of a removable deflector 20. The electrical wires to the light assembly are omitted for clarity. The light assembly 18 comprises a socket retainer 26, a bulb socket 28, and a light bulb 30. Light bulb socket 28 provides the seat for the light bulb 30 and the required electrical contact means and wires to permit the application of suitable electrical energy to the light bulb. Socket 28 is designed to be press fit into the lower portion of socket retainer 26 as seen in FIG. 1(*b*) and in turn, socket retainer 26 is designed to be either press fit or threaded into the exterior end of the deflector 20. Deflector 20 provides a transparent or translucent angled surface 21 which is seen three dimensionally in FIG. 1(*b*) and in cross-section in FIG. 4. Surface 21 is preferrably provided at an angle of about 60 degrees relative to the axis of extension 24. The center of surface 21 is preferably positioned at the intersection of the axes of extension 22 and 24. Deflector 20 also provides a plurality of wrench pins 32 which are preferably spaced equidistantly around the periphery of a flange 31 which is designed to seal against the interior surface of the housing 12 when seated therein and securely mated therewith by means of a thread 33 on the deflector and a mating threaded aperture 35 seen in FIG. 9. An O-ring (not shown) is preferrably placed between the flange and housing to provide a secure seal.

Figure 2:
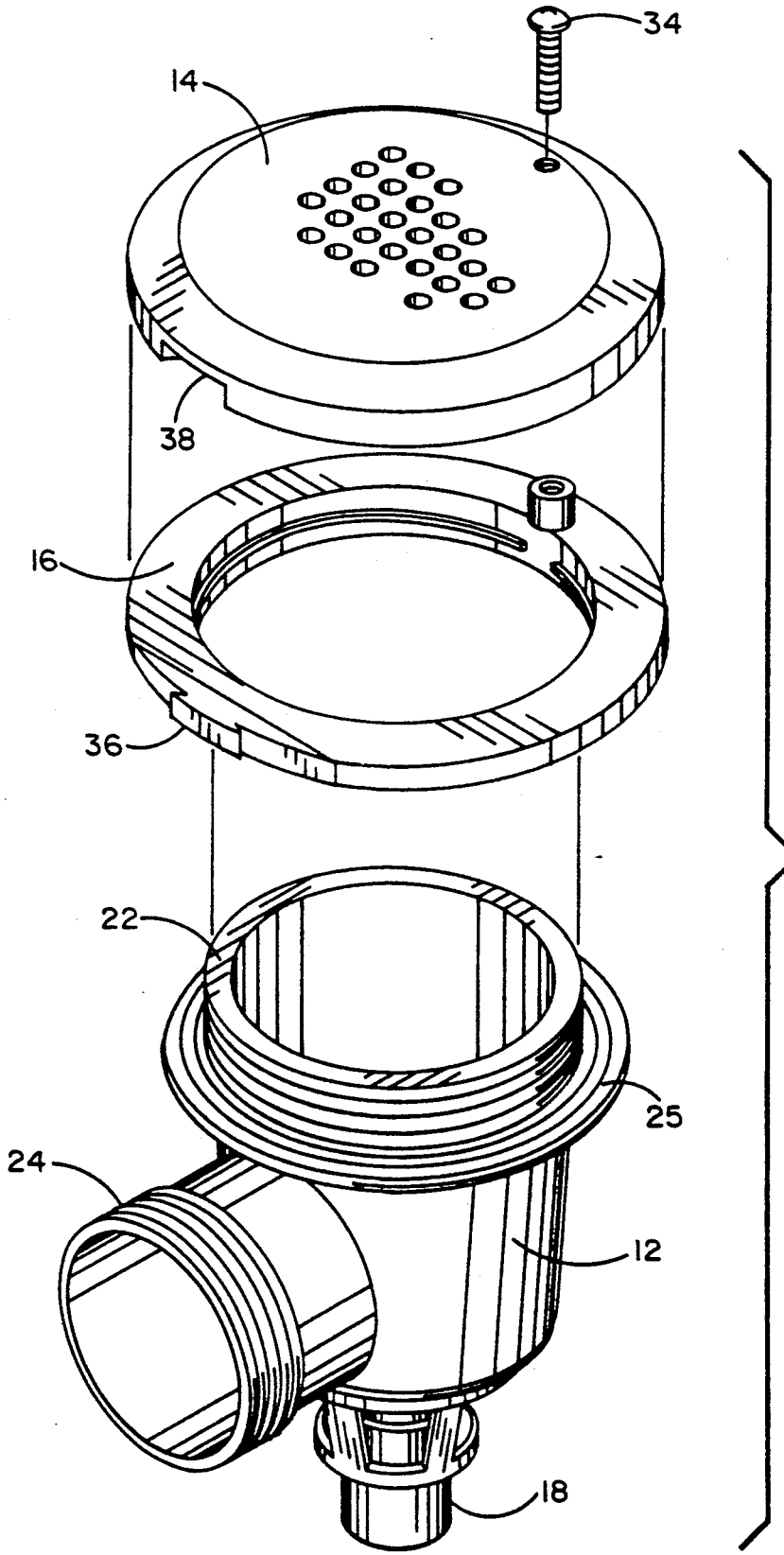
FIG. 2 is an exploded view of the remaining portions of the suction assembly of the present invention.
Figure 3:
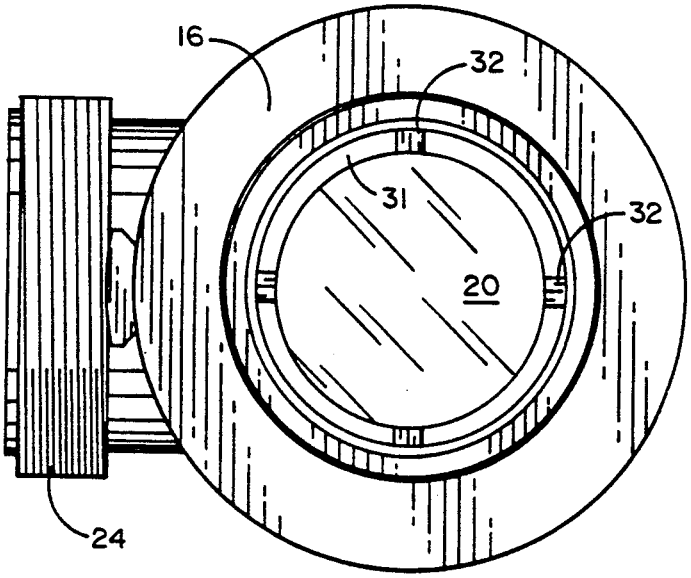
FIG. 3 is a plan view of the combined light and suction assembly of the present invention taken at the entrance to the suction assembly with the suction cover removed therefrom.
Figure 4:
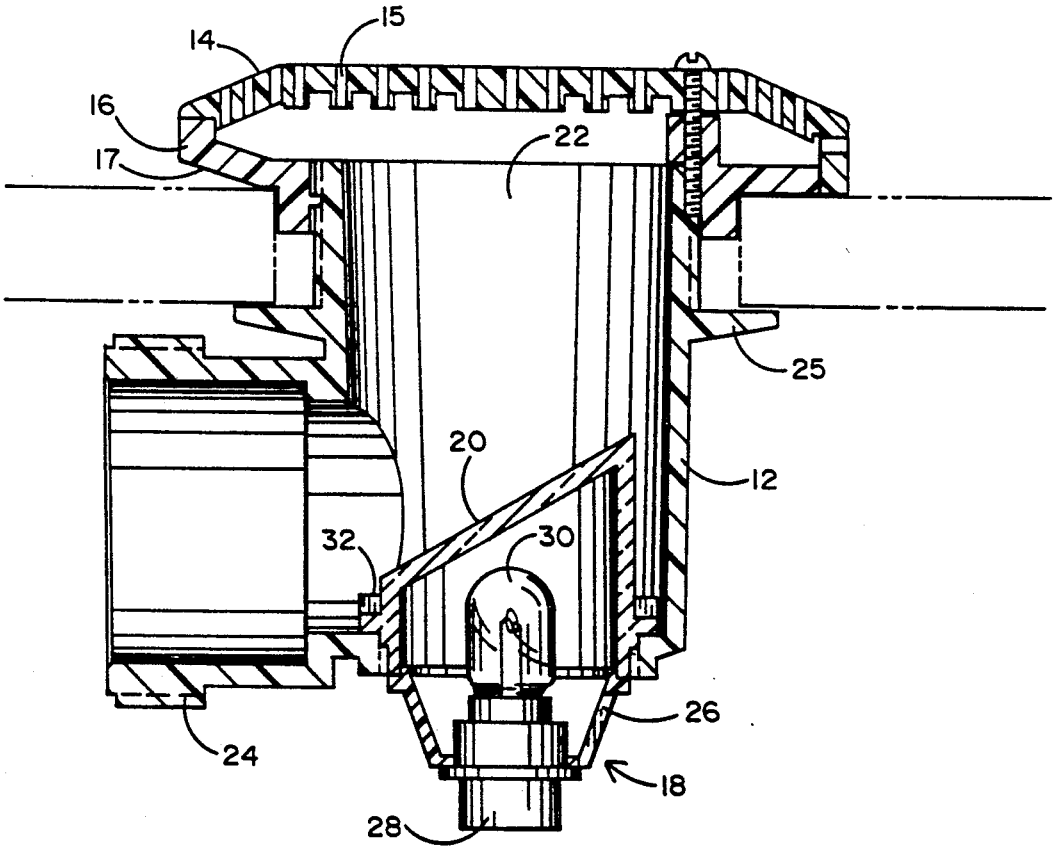
FIG. 4 is a cross-sectional view of the combined light and suction assembly of the present invention shown installed on a bathtub wall.

As seen in FIG. 4, when fully assembled, the lighted suction elbow assembly of the present invention is designed to be mounted into a tub wall through a suitably sized aperture in the tub wall to permit the threaded tub extension 22 of the housing 12 to extend through that aperture. A flange 25, seen three dimensionally in FIG. 2, is designed to act cooperatively with the washer 16 and the suction cover 14, in order to secure the elbow assembly to the tub wall in the manner shown in FIG. 4. It can also be seen in FIG. 4 that the deflector 20 has an outer diameter which is smaller than the inner diameter of the housing 12 and in fact sufficiently smaller to leave a perimeter gap around the entire removable deflector 20. Thus, as seen in FIG. 3, when the suction cover 14 has been removed from the interior of the tub, one can then see the deflector 20, as well as the plurality of wrench pins 32 spaced around the perimeter of the deflector. These pins are accessibly positioned for receiving an appropriate tool which grasps the pins and rotates the deflector to unthread it from the housing 12 in order to remove the deflector and the light assembly 18 through the interior of the tub as will be shown in more detail hereinafter.

Figure 5:
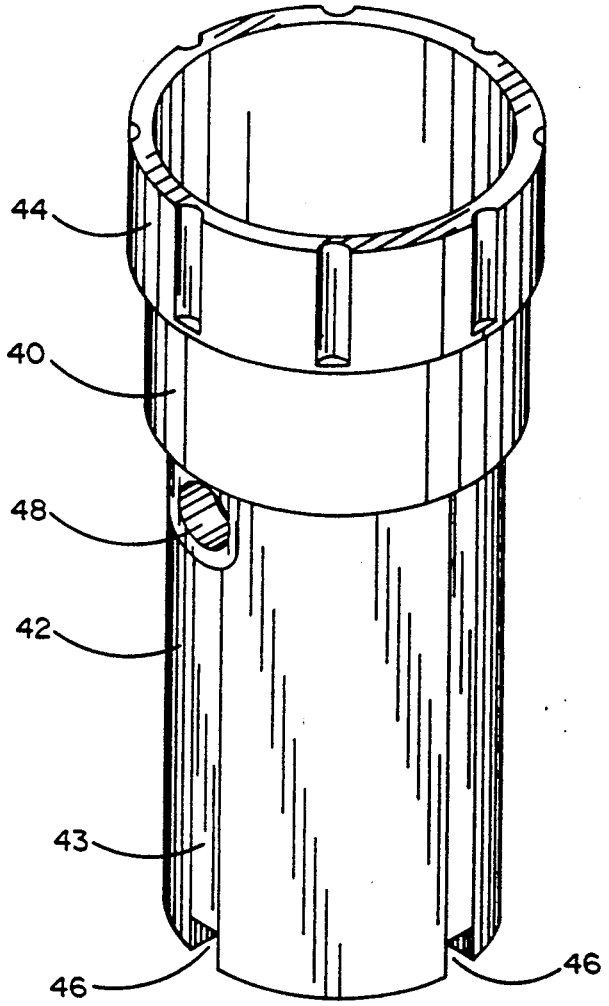
FIG. 5 is a three-dimensional view of a wrench tool that may be advantageously used to remove and replace the light assembly of the invention.
Figure 6:
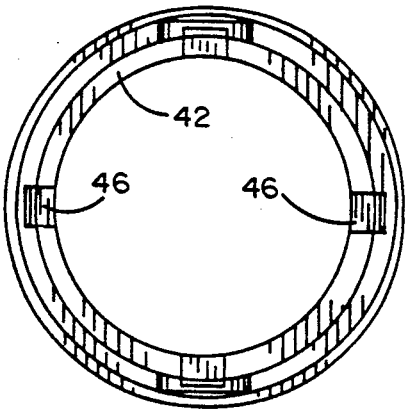
FIG. 6 is a plan view of the wrench tool of FIG. 5 taken along the surface thereof that engages the deflector of the present invention.
Figure 7:
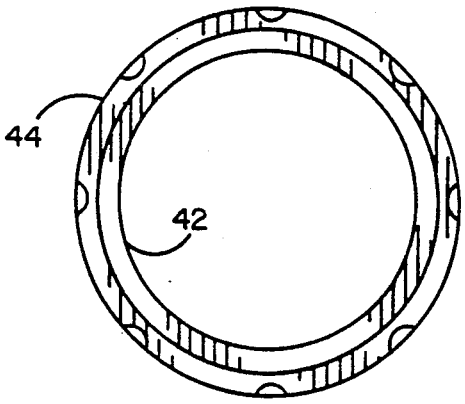
FIG. 7 is a plan view of the tool of FIG. 5 taken at the opposite end of the tool along the gripping portion thereof.

The tool for grasping the wrench pins 32 is shown in FIGS. 5 through 7. This light assembly removal tool 40 comprises an elongated hollow cylinder 42, one end of which is formed into a slotted or undulated grip 44 and the other end of which is provided with a plurality of wrench pin keys 46 in the form of rectangular slots of the proper size and position to be received by the wrench pins 32 of the removable deflector 20. Cylinder 42 is also provided with a plurality of longitudinal ribs 43 which are positioned in alignment with the wrench pin keys 46 for provided added structural support to the tool and particularly to the region of the keys which engage the wrench pins 32. In addition, a pair of radially opposed holes 48 are provided to facilitate injection molding manufacture of the tool 40.

Figure 8:
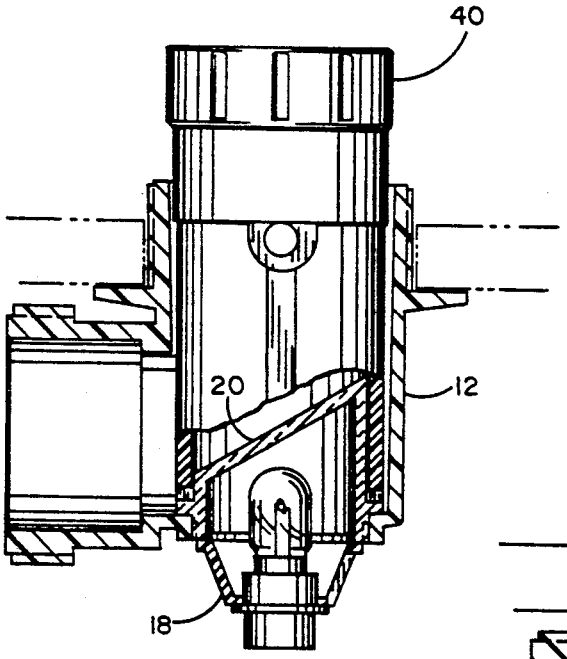
FIG. 8 is a partially cross-sectioned view of the present invention and a partially cut-away view of the tool thereof showing the position of the tool for installing or removing the light assembly from the suction elbow of the preferred embodiment.
Figure 9:
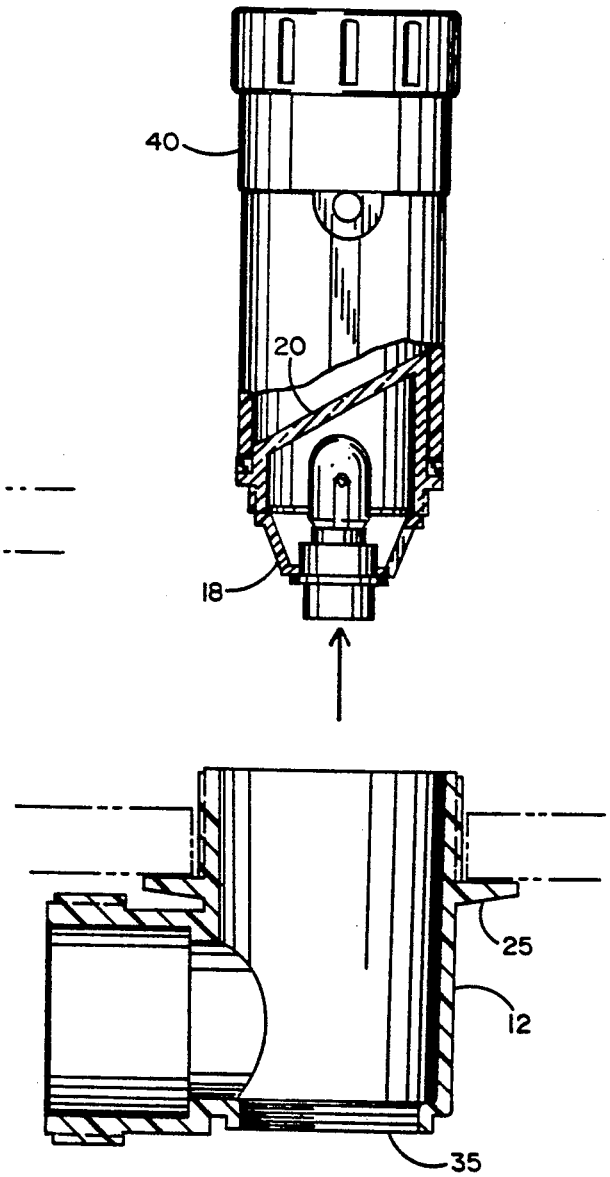
FIG. 9 is a view similar to that of FIG. 8, but showing the tool having been removed from the suction elbow with the light assembly in the tool such as for replacement of the bulb therein.

The use of tool 40 to remove the light assembly 18 may be best understood by referring to FIGS. 8 and 9. In FIG. 8, the tool 40 is shown fully inserted into the housing 12 after the suction cover 14 has been removed. As seen in FIG. 8, the tool 40 is of the appropriate length to permit engagement of the wrench pin keys 46 of tool 40, with the wrench pins 32 of the removable deflector 20, while permitting the grip end 44 of the tool 40 to extend beyond the end of threaded tube extension 22 so that it may be grasped and turned inside the tub wall. Of course, such turning with the keys 46 engaging the pins 32 will cause unthreading of the deflector threads 33 from the elbow threads 35 so that upon complete disengagement of such threads, the light assembly 18 may be removed with the tool 40 from the housing 12, as shown in FIG. 9. It will be understood that once the tool and light assembly are removed from the suction elbow housing, the light assembly may be readily disassembled to remove the bulb and replace it with a new one. The tool is then used to re-assemble the light assembly to the housing by reversing the steps shown in FIGS. 8 and 9.

It will now be understood that what has been disclosed herein comprises an improved combination suction elbow assembly and light assembly for use in conjunction with whirlpool bath systems, wherein the embodiment of the invention shown herein is uniquely configured to provide a light assembly which may be readily removed from the inside of the bathtub for replacement of the bulb. The light assembly of the present invention is configured behind a removable deflector with a light transmissive angled surface. The deflector's angled surface minimizes the effect of the light assembly on flow through the suction elbow. In addition, the removable deflector provides a water tight seal connection to prevent any water from reaching the light assembly. A simple tool in the form of an elongated cylinder, having a plurality of wrench pin keys is disclosed. The keys are adapted to engage wrench pins along the peripheral surface of a flange of the removable deflector to enable easy threading and unthreading of the deflector into the housing from inside the tub, without requiring any access from outside the tub.

Those having skill in the art to which the present invention pertains, will as a result of the applicant's teaching herein, perceive various modifications and additions which may be made to the invention. Thus for example, a particular geometry for the removable deflector and light assembly of the present invention has been disclosed, and wherein a specific tool for removing and replacing the removable deflector and light assembly has been disclosed. However, it will be understood that other configurations which serve the same purpose as herein disclosed, such as minimum interference with flow, a reliable water seal between the water flow and electrical assembly of the bulb and, most importantly, easy removal from inside the tub of the light assembly for replacement and maintenance of the bulb assembly with or without a tool, are all contemplated by the present invention. Accordingly, all such modifications and additions are deemed to be within the scope of the invention which is to be limited only by the claims appended hereto and their equivalents.

I claim:

1. An improved suction assembly for use in whirlpool bath systems of the type installed on a tub, the tub having an interior at least partially filled with water, the suction assembly removing water from the tub through a removable multi-apertured cover while at least one whirlpool jet delivers a mixture of water and air into the tub through a Venturi-type flow channel and a nozzle; the improvement comprising:

a light assembly connected to said suction assembly, said suction assembly having at least one light transmissive surface for passing light from said light assembly into said tub interior while preventing water from reaching said light assembly;

means for removing said light assembly from said suction assembly from said tub interior for replacement of worn light bulbs.

2. The improvement recited in claim 1 wherein said at least one light transmissive surface comprises a light transmissive deflector for receiving said light assembly, the deflector being threadably connected to said suction assembly and having a surface for deflecting water away from said light assembly.

3. The improvement recited in claim 2 wherein said deflector comprises at least one wrench pin for rotating said deflector for threadably connecting and disconnecting said deflector to and from said suction assembly.

4. The improvement recited in claim 3 further comprising a tool having one end with at least one wrench pin key for engaging said wrench pin and having another end for grasping said tool from said tub interior while said key engages said pin.

5. The improvement recited in claim 2 wherein said suction assembly is configured as an elbow having a tub extension and an elbow extension substantially perpendicular to said tub extension for altering the direction of water being removed from said tub, said tub extension and said elbow extension having intersecting axes, said deflector surface being located at about the point of intersection of said axes and forming an angle in the range of about 30 degrees to about 60 degrees with each of said axes.

6. A suction elbow for use in whirlpool bath systems of the type installed on a tub, the tub having an interior at least partially filled with water, the suction elbow removing water from the tub through a removable multi-apertured cover while at least one whirlpool jet delivers a mixture of water and air into the tub through a Venturi-type flow channel and a nozzle; the improvement comprising:

a light assembly connected to said suction elbow, said suction elbow having at least one light transmissive surface for passing light from said light assembly into said tub interior while preventing water from reaching said light assembly; said at least one light transmissive surface comprising a light transmissive deflector for receiving said light assembly, the deflector being threadably connected to said suction elbow for removal from said elbow at said tub interior and having a surface for deflecting water away from said light assembly.

7. The improvement recited in claim 6 wherein said deflector comprises at least one wrench pin for rotating said deflector for threadably connecting and disconnecting said deflector to and from said suction elbow.

8. The improvement recited in claim 7 further comprising a tool having one end with at least one wrench pin key for engaging said wrench pin and having another end for grasping said tool from said tub interior while said key engages said pin.

9. The improved suction elbow recited in claim 6 wherein said elbow comprises a tub extension and an elbow extension substantially perpendicular to said tub extension for altering the direction of water being removed from said tub, said tub extension and said elbow extension having intersecting axes, said deflector surface being located at about the point of intersection of said axes and forming an angle in the range of about 30 degrees to about 60 degrees with each of said axes.

10. A combined suction elbow and light assembly for use on tub walls in conjunction with whirlpool bath systems; the combination comprising:

an elbow housing having a tub extension and an elbow extension oriented at about a right angle to said tub extension;

a light transmissive, multi-apertured suction cover removably connected to an open end of said tub extension;

a deflector having a light transmissive angled surface positioned at a transition area in said housing between said tub extension and said elbow extension, further having means for removeable connection to said housing and means for engaging a light assembly behind said angled surface; and means for removing said deflector through said tub extension upon removal of said suction cover.

11. The combination recited in claim 10 wherein said deflector comprises at least one wrench pin for rotating said deflector for threadably connecting and disconnecting said deflector to and from said housing.

12. The combination recited in claim 11 further comprising a tool having one end with at least one wrench pin key for engaging said wrench pin and having another end for grasping said tool from said tub interior while said key engages said pin.

13. The combination recited in claim 10 wherein said angled surface is at an angle of about 30 degrees relative to said elbow extension.

* * * * *